US009752838B2

(12) United States Patent
Parker et al.

(10) Patent No.: US 9,752,838 B2
(45) Date of Patent: Sep. 5, 2017

(54) MAGAZINE LOADING ASSEMBLY

(71) Applicants: Robert T Parker, Mundelein, IL (US); Michael T Parker, Mundelein, IL (US)

(72) Inventors: Robert T Parker, Mundelein, IL (US); Michael T Parker, Mundelein, IL (US)

( * ) Notice: Subject to any disclaimer, the term of this patent is extended or adjusted under 35 U.S.C. 154(b) by 0 days.

(21) Appl. No.: 15/225,975

(22) Filed: Aug. 2, 2016

(65) Prior Publication Data

US 2017/0205169 A1 Jul. 20, 2017

Related U.S. Application Data

(60) Provisional application No. 62/279,084, filed on Jan. 15, 2016.

(51) Int. Cl.
*F41A 9/67* (2006.01)
*F41A 9/69* (2006.01)

(52) U.S. Cl.
CPC .. *F41A 9/67* (2013.01); *F41A 9/69* (2013.01)

(58) Field of Classification Search
CPC ..... F41A 9/67; F41A 9/69
USPC ..... 42/50, 6, 7, 49.01, 49.02, 87; 89/33.5
See application file for complete search history.

(56) References Cited

U.S. PATENT DOCUMENTS 1,500,580 A * 7/1924 Fererro ..... F41A 9/67 42/50
2,910,795 A * 11/1959 Agren ..... F41A 9/67 206/3
3,736,686 A * 6/1973 Moller ..... F41A 9/83 42/50
3,789,531 A * 2/1974 Kersten ..... F42B 39/00 206/3
4,037,344 A * 7/1977 Reed ..... F41A 9/58 42/16
4,430,821 A * 2/1984 Vincent ..... F41A 9/67 42/50
5,309,660 A * 5/1994 Blackamore ..... F42B 33/14 42/106
6,874,618 B1 * 4/2005 Cragg ..... F42B 39/02 206/3
7,200,964 B2 * 4/2007 Gates ..... F41A 9/71 42/49.01
8,468,730 B2 * 6/2013 Faifer ..... F41A 9/67 42/50
8,650,792 B1 * 2/2014 Overmars ..... F41A 9/83 42/87
8,726,561 B1 * 5/2014 Hampton ..... F41A 9/65 42/106
8,887,428 B1 * 11/2014 Lemoine ..... F41A 9/61 42/49.01
9,010,005 B2 * 4/2015 Faifer ..... F41A 9/65 42/49.01
9,103,614 B2 * 8/2015 Froehle ..... F41A 9/67
9,121,652 B1 * 9/2015 Mangiameli ..... F41A 9/64
9,303,934 B1 * 4/2016 Kazsuk ..... F41A 9/83
9,459,063 B1 * 10/2016 Gatturna ..... F41A 9/83
2007/0157501 A1 * 7/2007 Cammenga ..... F41A 9/67 42/87
2009/0094875 A1 * 4/2009 Kim ..... F41A 9/62 42/1.02

(Continued)

*Primary Examiner* — John D Cooper

(57) ABSTRACT

A magazine loading assembly consists of telescoping segments that pull down a magazine spring plate, but leave the magazine follower in place, to release the spring pressure and allow for ease in loading.

5 Claims, 5 Drawing Sheets

(56) References Cited

U.S. PATENT DOCUMENTS

| | | | | |
|---|---|---|---|---|
| 2011/0030259 | A1* | 2/2011 | Castro | F41A 9/67<br>42/6 |
| 2012/0030987 | A1* | 2/2012 | Lee, III | F41A 9/67<br>42/87 |
| 2014/0283427 | A1* | 9/2014 | Castro | F41A 9/67<br>42/49.01 |
| 2014/0373421 | A1* | 12/2014 | Hatch | F41A 9/83<br>42/87 |
| 2015/0075052 | A1* | 3/2015 | Boyarkin | F41A 9/67<br>42/87 |
| 2015/0316341 | A1* | 11/2015 | Aguilar | F41A 9/83<br>42/87 |
| 2015/0377573 | A1* | 12/2015 | Niccum | F41A 9/83<br>42/87 |

* cited by examiner

MAGAZINE LOADING ASSEMBLY

CROSS-REFERENCE TO RELATED APPLICATION

This application claims the benefit of U.S. Provisional Patent Application No. 62/279,084 filed Jan. 15, 2016, which is hereby incorporated by reference in its entirety herein.

BACKGROUND OF THE INVENTION

I. Field of the Invention

The present disclosure relates generally to cartridge magazines for firearms, and more specifically to an easy-load ammunition magazine or clip for use in magazine fed firearms.

II. Description of the Prior Art

Conventional firearm cartridge clips require that the ammunition shells be manually loaded one at a time through an upper opening into the magazine overcoming the progressively increasing resistance of a magazine spring. In general, each shell, as it is being loaded, is pressed against a previously loaded shell requiring considerable finger dexterity and strength. Indeed, this loading operation requires increasing force as more rounds of ammunition are loaded into the magazine and the magazine spring is progressively compressed. This loading operation thus requires the firearm user to apply progressively increasing loading forces with their finger, which in turn progressively increases the fatigue on the finger, which in turn may cause pain and possible injury.

Accordingly, many people do not have the prerequisite finger strength or dexterity to manually load a firearm cartridge clip. Others are only able to partially load the clip, as the dexterity and strength required to fully load the clip exceeds their capabilities.

Furthermore, even those who are able to load the magazine to its full capacity are typically unable to load the last several ammunition rounds as quickly as the first several ammunition rounds were loaded. Indeed, resistance of the clip spring can slow the speed with which a clip is loaded, as well as tire an individual that has to load multiple clips.

A plethora of attempts have been made to provide clips or devices to be used with clips to facilitate the loading of the ammunition shells into the magazine. Most of these attempts focus on drawing down the clip spring and follower, in one form or another, to reduce the loading resistance. Some of these designs have proven to be overly complex while others simply do not work for their intended purpose. The overly complex designs tend to be rather cumbersome and time consuming. And, the simpler designs increase the likelihood that the ammunition shells will fall into the clip in the vertical or diagonal orientation, requiring that the clip be emptied and reloaded. As such, there is currently nothing available to the firearm user that adequately addresses the aforementioned problems.

The present disclosure overcomes the problems associated with the loading of ammunition into conventional magazine clips. Accordingly, it is a general object of this disclosure to provide an improved magazine loading assembly for automatic and semi-automatic firearms.

It is another general object of the present disclosure to provide a magazine loading assembly that releases spring pressure to enable ease and efficiency of loading ammunition.

It is a more specific object of the present disclosure to provide a magazine loading assembly follower that maintains appropriate resistance, without spring pressure, to enable proper alignment and positioning of loaded ammunition.

It is another more specific object of the present disclosure to provide a self contained telescoping assembly within the magazine for releasing clip spring pressure.

These and other objects, features and advantages of this disclosure will be clearly understood through a consideration of the following detailed description.

SUMMARY OF THE INVENTION

According to an embodiment of the present disclosure, there is provided a firearm magazine loading assembly having a housing, a telescoping assembly within the housing including a bottom end and plurality of tubing segments having smaller top ends and larger bottom ends such that each smaller segment fits within an adjacent segment wherein the bottom segment extends through the bottom of the housing. A magazine spring within the housing is affixed at one end to the bottom of the housing and at the other end to a spring plate. A follower is positioned within the housing between the open top end and the spring plate whereby when the telescoping assembly is in a retracted and firing mode the spring urges the follower against a flange on the top end of the housing and when the telescoping assembly is in an extended and loading mode the spring does not urge the follower.

BRIEF DESCRIPTION OF THE DRAWINGS

The present disclosure will be more fully understood by reference to the following detailed description of one or more preferred embodiments when read in conjunction with the accompanying drawings, in which like reference characters refer to like parts throughout the views and in which.

DESCRIPTION OF THE PREFERRED EMBODIMENTS

One or more embodiments of the subject disclosure will now be described with the aid of numerous drawings. Unless otherwise indicated, use of specific terms will be understood to include multiple versions and forms thereof.

Figure 1:
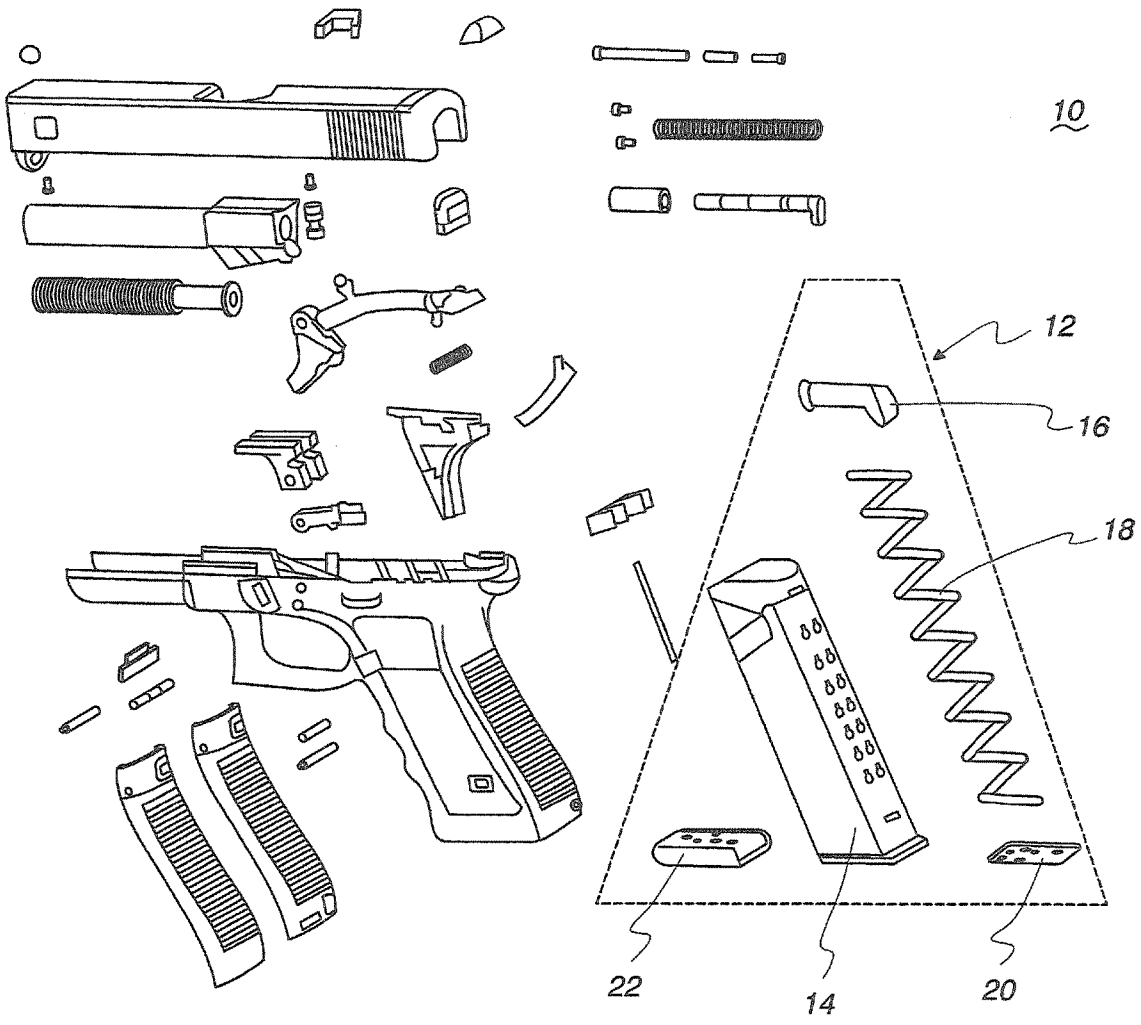
Fig. 1 (Prior Art)
FIG. 1 is an exploded view of the component parts of a conventional prior art semi-automatic pistol.
Figure 2A:
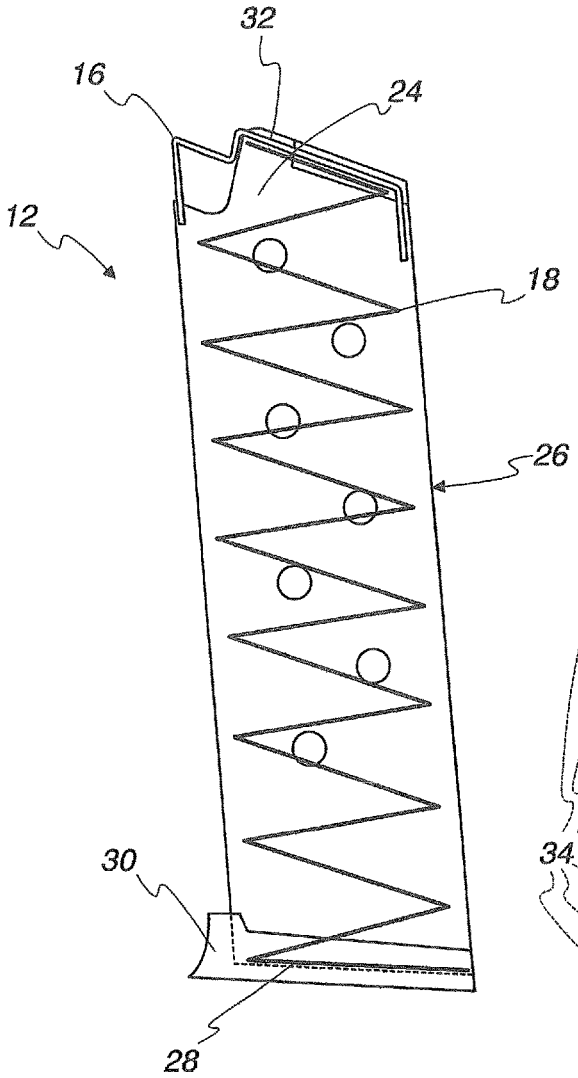
Fig. 2a (Prior Art)
FIG. 2*a* is a cross-sectional is the side view of a conventional prior art gun magazine without ammunition rounds loaded.
Figure 2B:
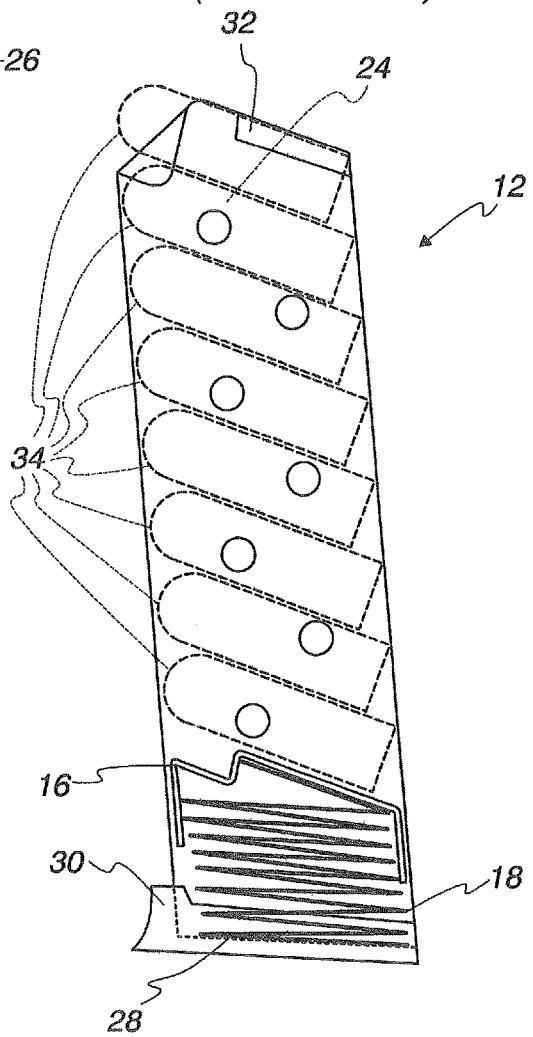
Fig. 2b (Prior Art)
FIG. 2*b* is the diagram of FIG. 2*a* with ammunition rounds loaded.

In any event, turning now to the Figures, and in particular FIG. 1, the component parts 10 of a conventional prior art semi-automatic pistol are shown. Specific to the present disclosure are the parts of the magazine assembly 12 including the magazine tube 14, the follower 16, the magazine spring 18, the magazine insert 20 and the magazine floorplate 22. Such a magazine assembly 12 is also illustrated in FIGS. 2*a* and 2*b*. FIG. 2*a* illustrates magazine spring 18 and magazine follower 16, which are located inside cavity (or chamber) 24 of the magazine frame 26. The upper end of the spring element 18 engages the underside of magazine follower 16, and the lower end of spring element 18 engages magazine base 28 (which is held in place by magazine end cap 30). Spring element 18 typically has a coiled (spiral) configuration within cavity 24.

Spring element 18 is under compression such that magazine follower 16 is forced upward into contact with flange 32. A shell is manually loaded into gun magazine 12 by pressing the cylindrical shaped sidewall of the shell down onto magazine follower 16. The shell and magazine follower 16 are moved downward against the force induced by spring element 18 until the shell is located substantially within cavity 24 and a gap exists between the upper surface of the shell and the lower surfaces of flanges 32. The shell is slid back into the gap while maintaining downward pressure on the shell. The downward pressure on the shell may be released such that the spring element 18 forces magazine follower 16 and the shell upward, thereby forcing the shell into engagement with flange 32. The next shell is manually loaded on top of the first shell in the same manner.

FIG. 2*b* illustrates eight shells 34 of ammunition loaded in gun magazine 12. As illustrated, spring element 18 is forced into a state of high compression by shells 24. The conventional method for loading gun magazine 12 is both difficult and time consuming. A person loading gun magazine 12 will typically experience tired and/or cramped fingers after repeated loading operations.

Indeed, some people find it difficult to manually load a firearm magazine due to the bias necessary within the magazine to keep the ammunition rounds in correct alignment both prior and after positioning within the firing chamber. The bias typically increases as more rounds are loaded into the magazine clip.

Accordingly, the present disclosure was conceived to eliminate this long existing difficulty of loading rounds into a magazine. In particular, the self contained unit relieves the spring pressure in the magazine and allows the rounds to be effectively loaded in the proper alignment. This assembly has been designed in a cost effective manner and can be incorporated into any magazine regardless of caliber or capacity for automatic and semi-automatic pistols and rifles.

Figure 3A:
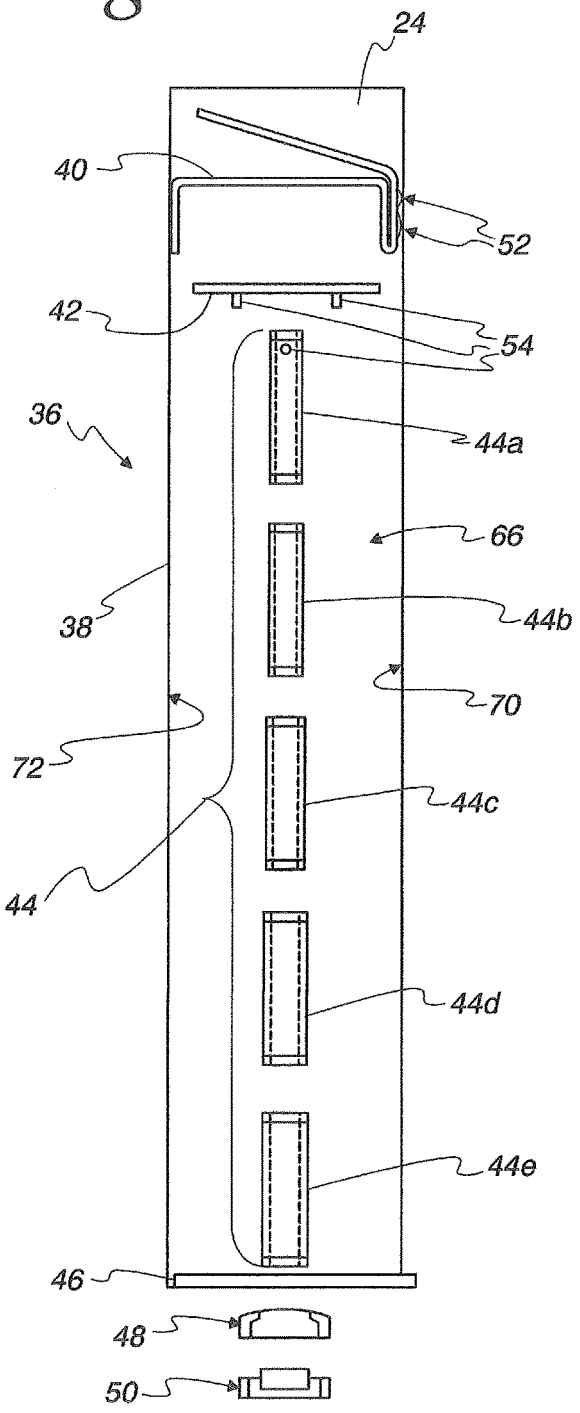
FIG. 3*a* is a cross-sectional side view of the magazine loading assembly according to the principles of an embodiment of the present disclosure.
Figure 3B:
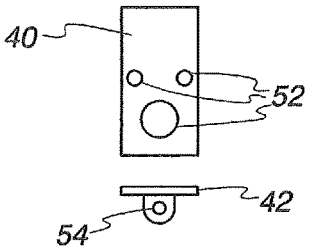
FIG. 3*b* is a rear view of the follower and spring plate components of FIG. 3*a*.

An embodiment of the present disclosure will now be illustrated through the remaining Figures. It will be understood that many of the main parts of a typical magazine (as shown in FIGS. 1-2*b*) remain. In any event, turning first to FIGS. 3*a* and 3*b*, the main magazine loading assembly 36 is shown, save for the spring element (shown later) to aid in the illustration. Inside the magazine assembly frame (or housing) 38 is the magazine follower (or cartridge support seat) 40, the magazine spring plate 42, the magazine telescoping assembly 44, the magazine floor plate 46. The telescoping assembly holder (or perhaps magnet) 48 and handle 50 are positioned outside of the magazine assembly frame 38. FIG. 3*b* illustrates both the spring detents 52 on the back plate of the follower 40 as well as the wire guide holes 54 on the underside of the spring plate 42 and the end of the first length of telescoping assembly 44.

The telescoping assembly comprises a number of segments (dependent upon magazine length) of tubing that are crimped smaller on one end and extruded larger on the other end such that each smaller segment fits within its adjacent segment. For example, segment 44*a* fits within segment 44*b*, which fits within segment 44*c*, which fits within segment 44*d* which then fits within segment 44*e*. The top end of the first segment 44*a* is coupled to the magazine spring plate 42 via wire (not shown) and wire guide holes 54. The bottom end of the last segment 44*e* is user graspable and may be coupled to holder 48 which in turn is coupled to handle 50. The magazine spring 56 (shown in FIGS. 4 and 5) may also be coupled on one end to the spring plate via guide holes 54 via crimping or welded and then similarly coupled to the top of the floor plate 46. While the magazine spring 56 of the disclosure may be a custom spring and accordingly customly attached, it may also be of conventional design and therefore affixed in any conventional manner.

Figure 4:
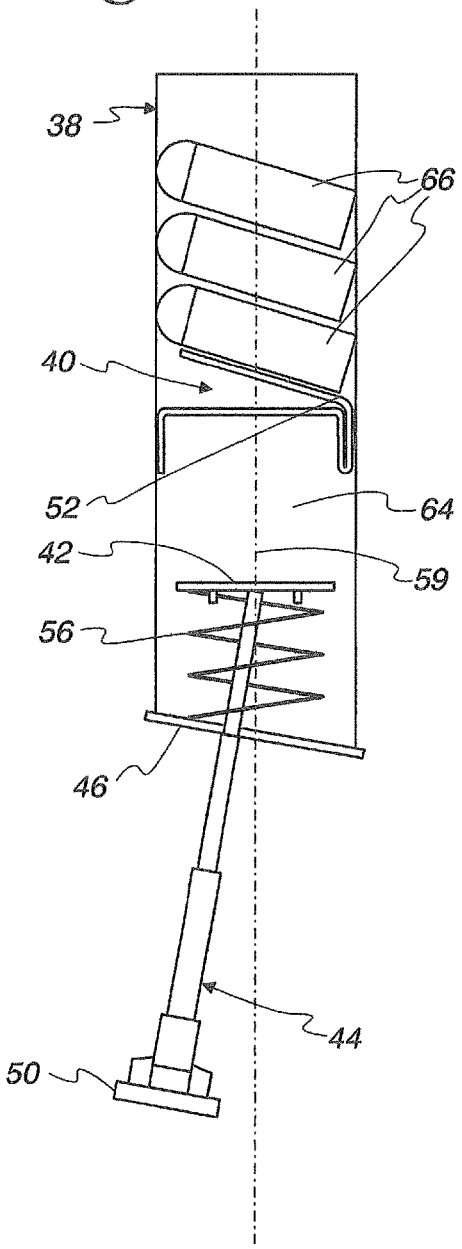
FIG. 4 is a cross-sectional side view of the magazine loading assembly of FIG. 3*a* in the locked and loading mode position.
Figure 5:
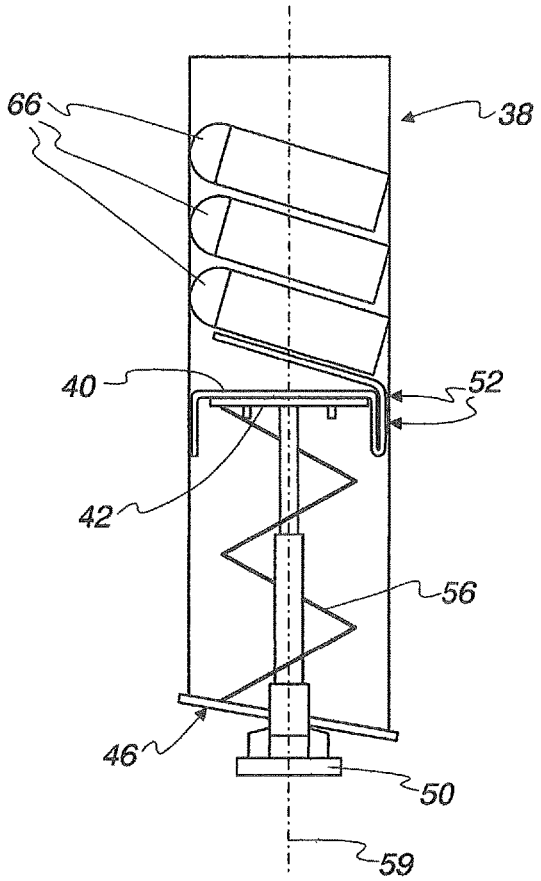
FIG. 5 is a cross-sectional side view of the magazine loading assembly of FIG. 3*a* in the retracted and ready for use firing mode position.
Figure 6:
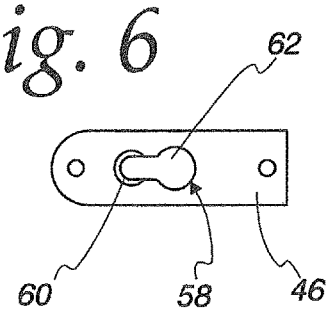
FIG. 6 is a bottom view of the floor plate component of FIG. 3*a*.

During the loading procedure, and turning now to FIGS. 4 and 6, the handle 50 is pulled down and the telescoping assembly 44 is positioned away from the telescoping assembly hole 58 of the floor plate 46, and off of the central axis 59 of the housing 38, and into the locking hole 60. These holes together comprise a coined keyhole 62. This releases the spring pressure and readies the magazine for loading. While the spring plate 42 is pulled down the assembly frame 38, the follower 40 remains positioned and aligned within the frame due to the frictional forces of the spring detents 52 against the inside wall of the frame 38. In other words, the follower 40 does not fall when the spring 56 is compressed. This is due to the fact that the follower 40 and the unique spring plate 42 are separate component parts and not otherwise coupled together. Indeed, there is no spring plate 42 in conventional magazines. As such, when the telescoping assembly 44 is pulled down and locked into the keyhole 62, there is space 64 between the follower 40 and the spring plate 42. As each round 66 of ammunition is loaded, this space 64 narrows, but remains aligned along the central axis 59 via detents 52, until the user has completed loading.

Once loading is complete, the telescoping assembly is unlocked from the keyhole 62, positioned along the central axis 59, retracted together, and the handle 50 is fastened to the bottom of the floor plate 46. The spring 56 then pushes the spring plate 42 against the follower 40 with the correct amount of pressure, and the magazine is ready to be inserted into the firearm and used.

Figure 7:
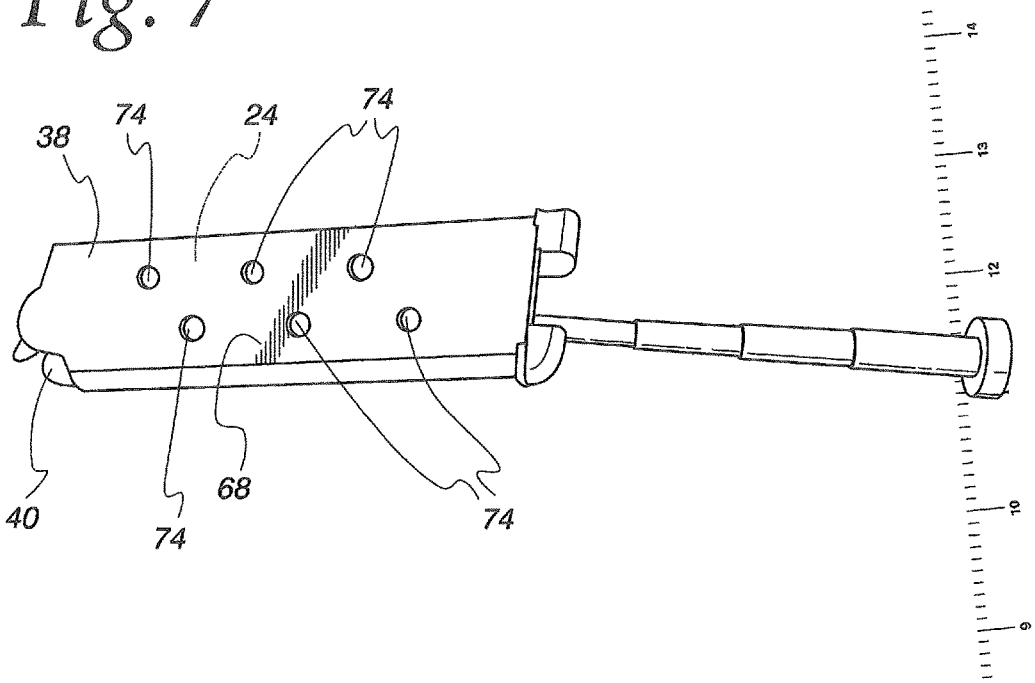
FIG. 7 is a side view of the magazine loading assembly in the locked and loaded position according to the principles of an embodiment of the present disclosure.
Figure 8:
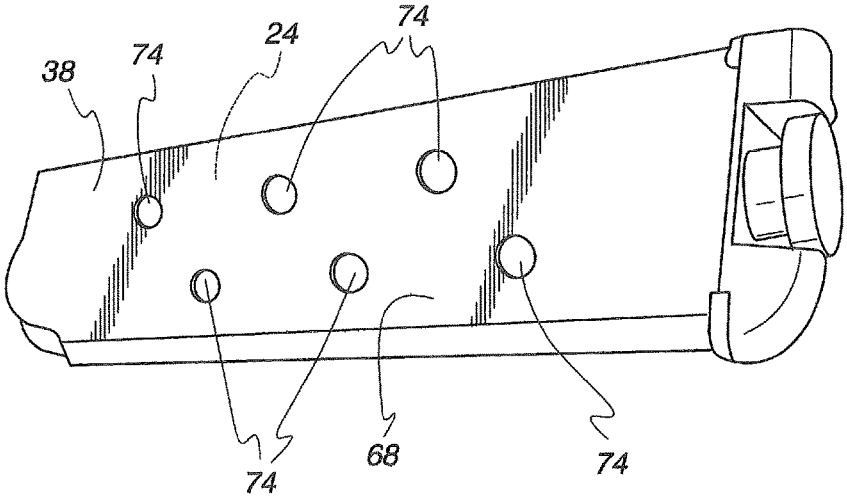
FIG. 8 is a side view of the assembly of FIG. 7 in the retracted position loaded with rounds of ammunition.

Turning now to FIGS. 7 and 8, the magazine assembly frame 38 is typically a metal structure that includes a cavity 24, which is dimensioned to closely receive a plurality of cartridges. As known to those of ordinary skill, a cartridge typically includes a bullet (or slug), a casing, and gunpowder. The cavity 24 is defined by a right side wall 66, a left sidewall 68, a back wall 70, rounded front wall 72 and a magazine base or floor plate 46. That said, in the loading mode of FIG. 7, the telescoping assembly 44 is pulled out and locked in place within the keyhole. While the spring plate has been pulled down, the follower 40 remains in place and ready to receive cartridges. The round counting apertures 74 reveal only space 64 in the cavity 24 between the follower 40 and the floorplate. When the magazine has been loaded and is in the firing mode of FIG. 8, the telescoping assembly 44 is retracted and fastened to the base. The round counting apertures 74 reveal no space between the follower

40 and the floorplate and the cartridge now has the correct spring pressure to be fired from the firearm.

It will be understood and appreciated that while the present disclosure has been shown and described as a single stack pistol magazine, the disclosure is in no way limited thereto. Indeed, this subject magazine loading assembly is also ideal for multiple stacks and any make and caliber. Additionally, while the telescoping segments were described as temper stainless steel surgical tubes, machined stainless segments or plastic may be used. Similarly, the follower may be made of plastic with dimples (detents) or leaf springs or any other element to obtain the correct amount of frictional resistance.

One alternate embodiment of the magazine assembly frame 38 is to taper one or more of the walls inward as they progress towards the floor plate 46. This may be beneficial in a double stack magazine when the weight of the rounds may cause the follower to fall too freely. A tapered chamber would allow for the correct resistance for the entire length of rounds without decreasing the main spring to push the rounds up to the firearm feed lips.

The foregoing detailed description has been given for clearness of understanding only and no unnecessary limitations should be understood therefrom. Accordingly, while one or more particular embodiments of the disclosure have been shown and described, it will be apparent to those skilled in the art that changes and modifications may be made therein without departing from the invention if its broader aspects, and, therefore, the aim in the appended claims is to cover all such changes and modifications as fall within the true spirit and scope of the present disclosure.

What is claimed is:

1. A firearm magazine loading assembly comprising:

a housing dimensioned for a stack of ammunition, said housing including a bottom, a front wall, a back wall, and two side walls, said housing further including an open top end with a flange;

said bottom comprising a floor plate having a main aperture;

a telescoping assembly within said housing having a plurality of tubing segments having smaller top ends and larger bottom ends such that each smaller segment fits within an adjacent larger segment and wherein the bottom end of the bottom segment extends through said main aperture and is coupled to a handle outside of said housing and the top end of the top segment is coupled to a spring plate within said housing;

a magazine spring within said housing having one end affixed to said floor plate and another end affixed to said spring plate; and a follower positioned within said housing between said open end of said housing top and said spring plate whereby when said telescoping assembly is in a retracted and firing state said spring urges said follower against said flange and when said telescoping assembly is in an extended and loading state said spring does not urge said follower against said flange.

2. The assembly as defined in claim 1 wherein said floor plate includes a smaller aperture adjacent said main aperture for locking said telescoping assembly into said loading state.

3. The assembly as defined in claim 2 wherein said smaller aperture and main aperture form a coined keyhole.

4. The assembly as defined in claim 1 wherein said follower includes one or more detents frictionally engaging one or more of said walls of said housing.

5. The assembly as defined in claim 1 wherein said housing is dimensioned for a multiple stack of ammunition.

* * * * *